US008744338B2

(12) United States Patent
DeLuca

(10) Patent No.: US 8,744,338 B2
(45) Date of Patent: Jun. 3, 2014

(54) BROADCAST RECEIVER METADATA AUGMENTATION WITH MOBILE TRANSCEIVER

(75) Inventor: Michael Joseph DeLuca, Boca Raton, FL (US)

(73) Assignee: BlackBerry Limited, Waterloo (CA)

( * ) Notice: Subject to any disclaimer, the term of this patent is extended or adjusted under 35 U.S.C. 154(b) by 298 days.

(21) Appl. No.: 12/623,343

(22) Filed: Nov. 20, 2009

(65) Prior Publication Data

US 2011/0124283 A1 May 26, 2011

(51) Int. Cl.
*H04H 40/00* (2008.01)

(52) U.S. Cl.
USPC ..... 455/3.06; 455/3.01; 455/3.02; 455/3.03; 455/3.04; 455/414.1; 725/62; 725/63; 725/68; 725/70; 725/72

(58) Field of Classification Search
USPC ..... 455/3.01–3.06, 466, 422.1, 403, 550.1, 455/569.1, 569.2, 575.1, 90.3, 500, 517, 455/445, 414.1–414.4; 725/62–72
See application file for complete search history.

(56) References Cited

U.S. PATENT DOCUMENTS

| | | | | |
|---|---|---|---|---|
| 5,808,224 | A | 9/1998 | Kato | |
| 6,314,094 | B1 | 11/2001 | Boys | |
| 6,463,469 | B1 | 10/2002 | Yavitz | |
| 6,473,792 | B1 | 10/2002 | Yavitz | |
| 6,628,928 | B1 | 9/2003 | Crosby | |
| 2004/0064524 | A1 | 4/2004 | Van Steenbergen et al. | |
| 2004/0203406 | A1 | 10/2004 | Moran | |
| 2007/0010195 | A1 | 1/2007 | Brown | |
| 2008/0072270 | A1 | 3/2008 | Delegue et al. | |
| 2008/0108302 | A1* | 5/2008 | Linnamaki et al. | 455/3.06 |
| 2008/0227493 | A1* | 9/2008 | Yamazaki | 455/559 |
| 2009/0061764 | A1* | 3/2009 | Lockhart et al. | 455/3.06 |
| 2009/0061807 | A1* | 3/2009 | Zigler et al. | 455/303 |
| 2009/0157530 | A1* | 6/2009 | Nagamoto et al. | 705/27 |

(Continued)

FOREIGN PATENT DOCUMENTS

| | | | |
|---|---|---|---|
| EP | 1086540 | A1 | 3/2001 |
| EP | 1739925 | A1 | 1/2007 |
| WO | 9967904 | A1 | 12/1999 |
| WO | 0157758 | A1 | 8/2001 |
| WO | 02087120 | A1 | 10/2002 |

OTHER PUBLICATIONS

Grech, Sandro; Towards music download and radio broadcast convergence in mobile communications networks; Wireless Telecommunications Symposium; 2005.

(Continued)

*Primary Examiner* — Keith Ferguson
(74) *Attorney, Agent, or Firm* — Novak Druce Connolly Bove + Quigg LLP

(57) ABSTRACT

A mobile transceiver device can communicate with a separate broadcast radio receiver, to receive metadata concerning a main program being received by the broadcast radio receiver. The mobile transceiver device uses the metadata to formulate a request or search query, send the request or search query over a WLAN or cellular data network transceiver, to one or more sources of additional information, which respond with additional information. The additional information can comprise more detailed metadata about the main program as well as content and programming that facilitate a commerce transaction. For example, more detailed metadata can include song lyrics and album art when the main program is a song, while if the main program is an advertisement, the additional information can comprise information for furthering completion of a transaction.

21 Claims, 6 Drawing Sheets

(56) References Cited

U.S. PATENT DOCUMENTS

| | | | | |
|---|---|---|---|---|
| 2009/0239557 | A1 | 9/2009 | Kadakia et al. | |
| 2010/0009622 | A1* | 1/2010 | Chen | 455/3.01 |
| 2010/0049741 | A1* | 2/2010 | Harrison | 707/104.1 |
| 2010/0075593 | A1* | 3/2010 | Lee et al. | 455/3.06 |

OTHER PUBLICATIONS

Examination Report mailed Sep. 30, 2010; in corresponding European patent application No. 09176630.3.

Examination Report mailed Apr. 27, 2011; in corresponding European patent application No. 09176630.3.

Search Report mailed Apr. 20, 2010; in corresponding European patent application No. 09176630.3.

Summons to attend oral proceedings pursuant to Rule 115(1) EPC mailed on Mar. 6, 2012; in corresponding European patent application No. 09176630.3.

Car Karaoke Player—China electronic and Digital Products. http://www.o-digital.com/wholesale-products/2101/2202-2/Car-Karaoke-Player-57121.html. Retrieved on Apr. 13, 2012.

Office Action mailed Mar. 28, 2013, in corresponding Canadian patent application No. 2,720,169.

* cited by examiner

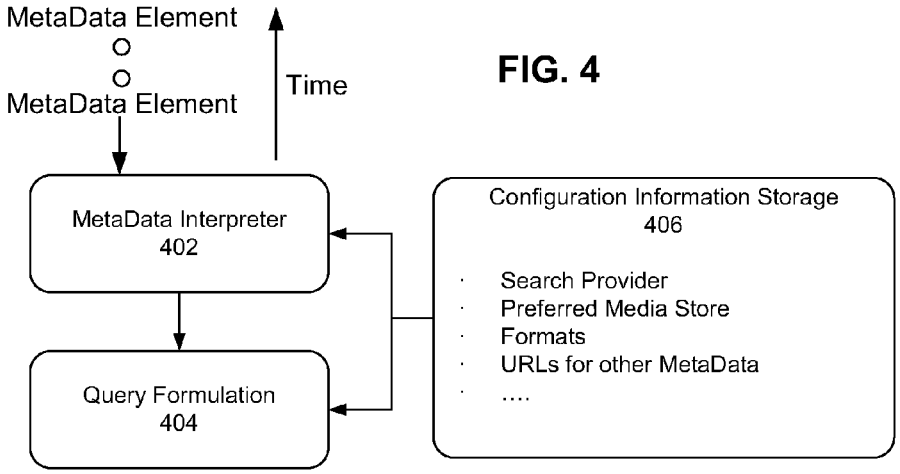
FIG. 4
FIG. 5
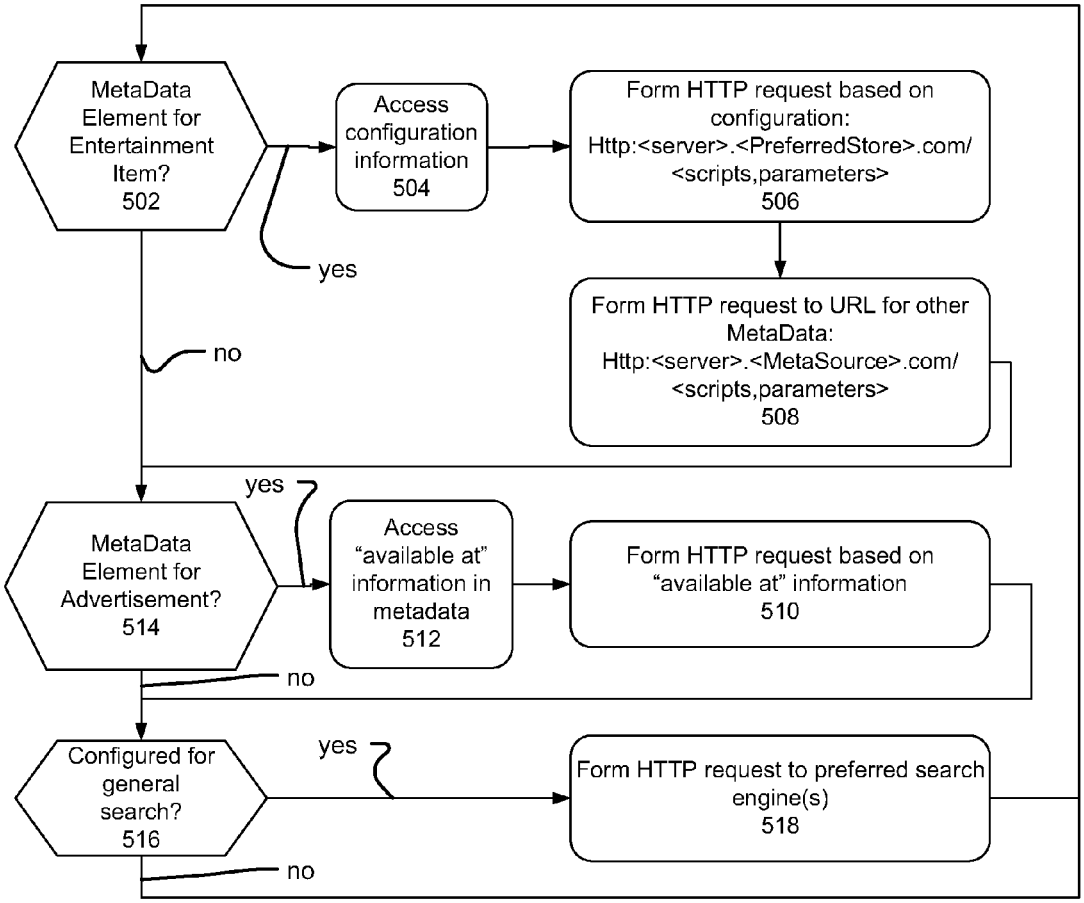

BROADCAST RECEIVER METADATA AUGMENTATION WITH MOBILE TRANSCEIVER

BACKGROUND

1. Field

The following relates to data-enabled mobile transceiver devices, such as data-enabled mobile phones, digital assistants, and smartphones, and more particularly to using these devices in conjunction with broadcast receivers for provision of enhanced data and services.

2. Related Art

Broadcasting of information, such as radio broadcasts of music and news, makes reasonably efficient usage of a given broadcast medium, considering a total number of devices that can receive a broadcast. However, a total amount of data that can be transmitted on a broadcast connection remains more limited than would desirably be available. Broadcasts largely are untargeted, by their nature, and thus, they do not provide an effect means to personalize information for a given receiver. Broadcasting does not provide an effective uplink channel, to get data from broadcast receivers to a broadcaster.

On the other hand, a transmission of content via cellular wireless transmission, such as streaming music to a smartphone, is much more targeted in its transmission, in that each smartphone user likely would select a particular stream of music to receive. However, an aggregate amount of bandwidth required to stream many separate streams of music from cellular transceiver towers, issues of tower handoff, as well as the typical way pay-per-usage model of most wireless data plans makes such an option difficult for carriers and expensive for consumers.

Some broadcasts, such as Frequency Modulated (FM) radio stations, with a Supplemental Channel Authorization (SCA) sideband, carry some metadata about the main program (e.g., a song title can be provided on the SCA channel for the song being broadcast on a given FM station). However, SCA provides a relatively low bandwidth way to communicate such data. Satellite and HD radio providers also include track title and artist metadata information on broadcasts. Further metadata included in broadcast content may briefly describe broadcast advertisements and news related segments. It would be desirable to have more metadata available in conjunction with such broadcasts, and also to facilitate commercial transactions relating to content being broadcast.

BRIEF DESCRIPTION OF THE DRAWINGS

In order to more fully explain describe various aspects, examples, and inventive embodiments, the following figures are provided, in which:

FIG. 4 depicts example functional modules that can be used in processing metadata based on configuration information;

FIG. 5 depicts an example of a method of query formation that can be used in the approach depicted in FIG. 4;

DETAILED DESCRIPTION

The following description provides examples and other disclosure, which teach those of ordinary skill in the art how to practice implementations and embodiments of inventive aspects described herein. As such, the description is not limiting, but rather is exemplary.

For convenience, in this description, the term "mobile transceiver device" (shorted in "device") is generally used to refer to any portable or mobile network-enabled device that has capabilities to send and receive data, such as data generated by web browsing, e-mail, SMS, instant messaging, and the like. As will become clear, a variety of devices in a variety of form factors can meet such a definition, including, for example, smartphones, laptops configured with appropriate network connections and user input devices, tablet computers, and netbooks. The term "mobile transceiver device" ("device") is also used herein to indicate a separate and distinct device from a broadcast radio receiver, such as a receiver that can be installed in an automobile or alternatively a home entertainment system. For example, such a receiver can comprise a satellite radio receiver installed in an automobile, while the mobile transceiver device can be a smartphone carried by a user of the automobile. The term "metadata" is used herein to refer to data describing or related to another data item, or group of data items. For example, metadata for a song comprises data identifying an album, a song title, an artist, a composer, and so on. Other information, such as song lyrics and video relating to the song can be considered metadata for the song. Metadata is a category of data, and thus, where the term "data" is used herein, it is not to the exclusion of types of data that can be considered "meta" for another element of data. For example, a particular element of data can be metadata for another metadata element.

Figure 1:
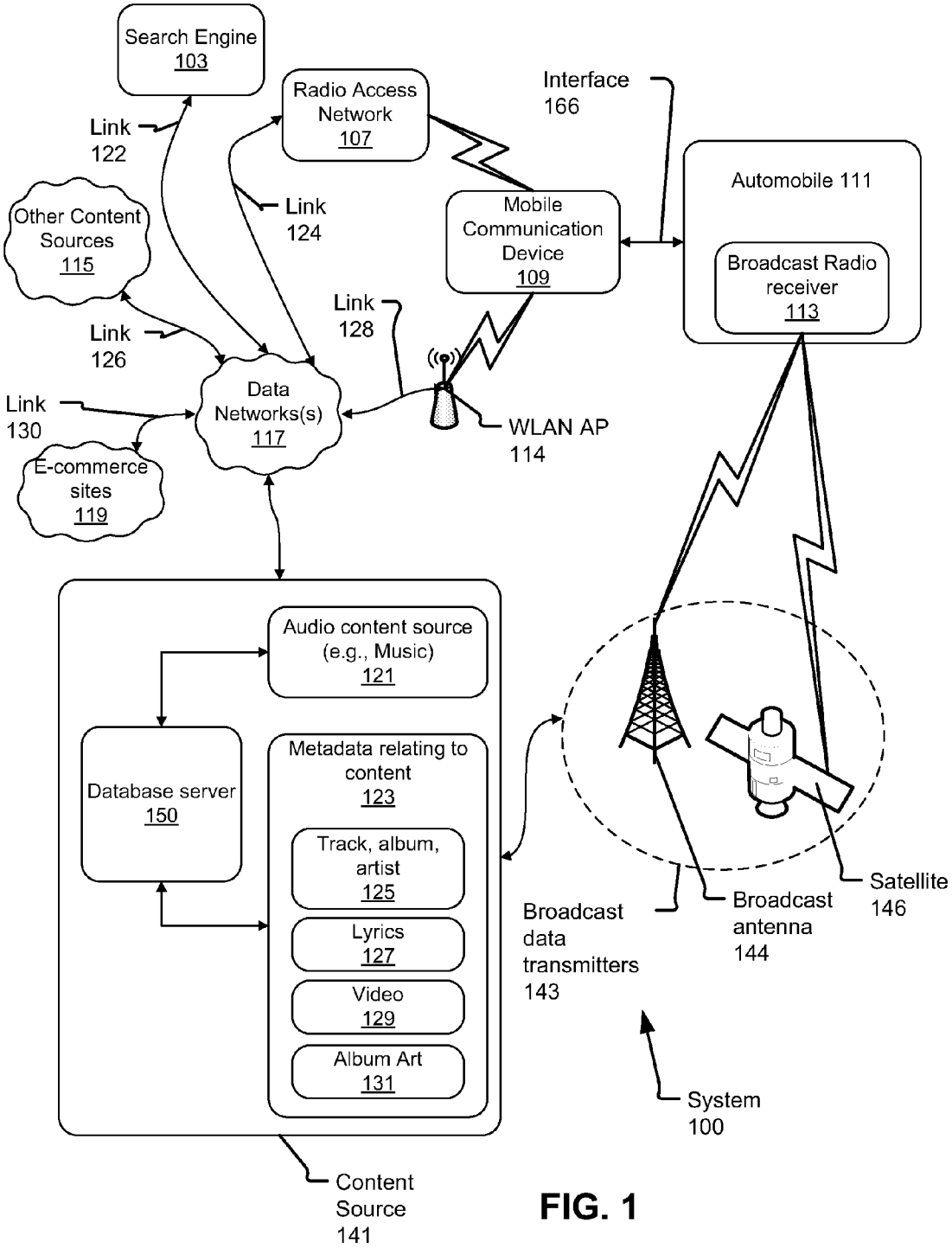
FIG. 1 depicts example components of a system in which described aspects can be embodied.

In a more specific example, FIG. 1 depicts a system architecture 100 in which a data-enabled mobile transceiver device 109 (device 109, hereinafter) can communicate with a broadcast radio receiver 113 over an interface 166. In one example, receiver 113 can be located or installed in an automobile 111.

Device 109 can communicate using a plurality of different wireless data communication protocols and standards. For example, device 109 can communicate over a radio access network (RAN) 107, which can be, for example, a cellular network. Examples of technologies that can be used for implementing RAN 107 include EDGE, UMTS, LTE, EVDO, GPRS, and other technologies for providing data transmit and receive capability to mobile devices.

Device 109 also can communicate with Local Area Network (LAN) wireless access points, such as WLAN AP 114. Technologies that can be used in providing such wireless LAN access include equipment based on the 802.11 series of IEEE standards. WLAN AP 114 can communicate over a link 128 with a data network 117, which in turn allows communication with e-commerce sites 119, over a link 130, sources of content 115, over a link 126. A search engine 103 (an example of one of a potential plurality of search engines) also is connected with data network 117 via link 122. Data network 117 can be implemented using the Internet, or more generally any collection of one or more networks that allow data communication among elements depicted in system 100.

A source of content 141 to be broadcasted to broadcast radio receiver 113 also can be connected with data network 117. Content source 141 comprises a source of audio or video content 121, such as music, news, and talk shows. Content source 141 also comprises metadata 123 relating to the content. Such metadata comprises one or more of track, album and artist metadata 125, lyrics metadata 127, and album art 131. Other data can comprise video 129, such as video relevant to music that can be broadcast. In the event the content is an advertisement, the metadata may include a sponsor name, phone number, a signal indicative of a URL, and/or any other advertiser (or advertisement) specific data.

Content source 141 communicates with broadcast data transmitters 143. Such broadcast data transmitters can comprise a broadcast antenna 144, such as for broadcasting Frequency Modulated (FM) or HD radio signals, and a satellite transmitter 146 for audio or video content (satellite transmitter 146 represents what may effectively be implemented by a number of separate orbiting entities). Content source 141 can include a database server 150 that is responsive to queries for additional data, such as additional metadata relating to a given content item, station, or program being received at broadcast receiver 113, as described further below.

The connections depicted can be implemented using public and/or private networks that can communicate using packet data technologies, such as X.25 or Internet Protocol (IP) based addressing and routing techniques. Some connections can be implemented as secure connections over leased lines, such as a frame relay, or using Virtual Private Network (VPN) technologies.

Thus, FIG. 1 depicts a system, where a mobile communications device (109) communicates over one or more data networks with sources of information and services. Device 109 also communicates with a broadcast radio receiver (receiver 113) over interface 166. Receiver 113 receives broadcasts by one or more different technologies, such as FM, and satellite radio. Interface 166 can be implemented, for example, using one or more local communication links, such as a Universal Serial Bus (USB) port, and a Bluetooth link, which can operate according to an extension of existing Microsoft® Sync technology. Currently, Sync provides a capability for a mobile transceiver device to send data to a computer system embedded in certain automobiles (such as automobile 111), and can use Bluetooth as a physical link. Sync can be used as a logical link connection to send the described metadata from the embedded computer system to device 109. Further explanation of the functioning of system 100 and methods for such are described below.

Figure 2:
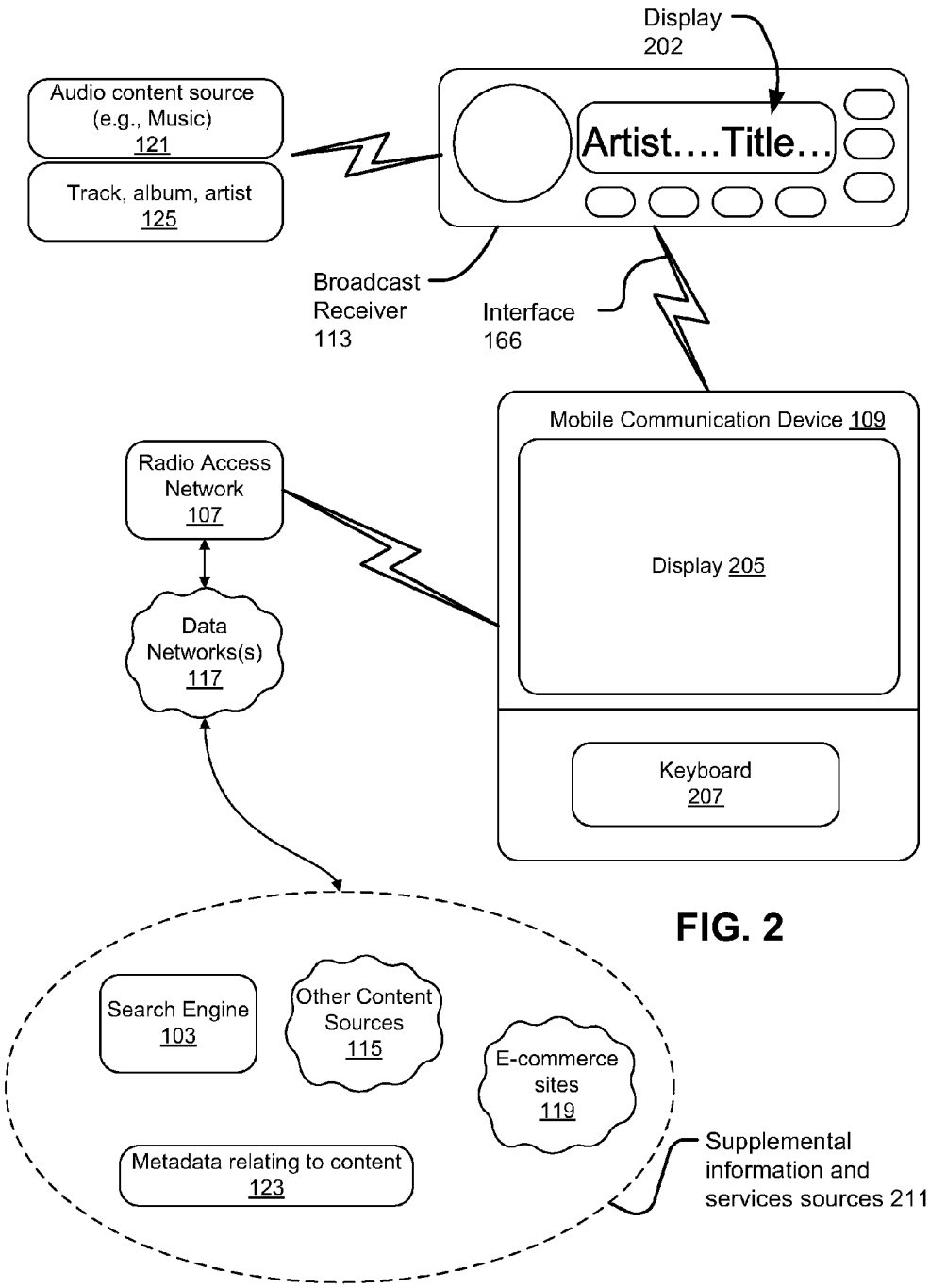
FIG. 2 depicts a further example of a flow of data among components depicted in FIG. 1.

FIG. 2 depicts that audio content 121 and limited metadata, such as track title, album and artist 125 are broadcasted to broadcast receiver 113. A display 202 provided with receiver 113 can display the metadata received by it. Receiver 113 communicates with device 109, such as over a Bluetooth connection. Device 109 has a display 205, and can include other functionality, such as a keyboard 207. Device 109 uses RAN 107 to communicate over data networks 117 with sources 211 of supplemental information and services. Examples of such sources were depicted in FIG. 1, and include search engine 103, e-commerce sites 119, metadata 123 relating to content being broadcast, other content sources 115 (termed, "other" in the sense that these sources can be sources other than a repository of metadata made available by an entity providing the audio and metadata being broadcast to receiver 113). Although separately categorized, a given source may be related to a plurality of these categories, for example, a site at which commerce can be conducted also can provide metadata or additional content to device 109. In some cases, a commercial transaction may have as its subject purchasing such additional content or metadata for content or a program being received by receiver 113.

Thus, FIG. 2 depicts a flow of broadcast data and metadata from a broadcaster to receiver 113. Receiver 113, as will be described in more detail below, provides metadata that it received (or at least some of it) to device 109 over interface 166. Device 109, also as described below, uses the received metadata in forming queries to obtain further data, services, or metadata that is selected in satisfaction of those queries. Receiver 113 can output audio for performance by speakers 203.

Figure 3:
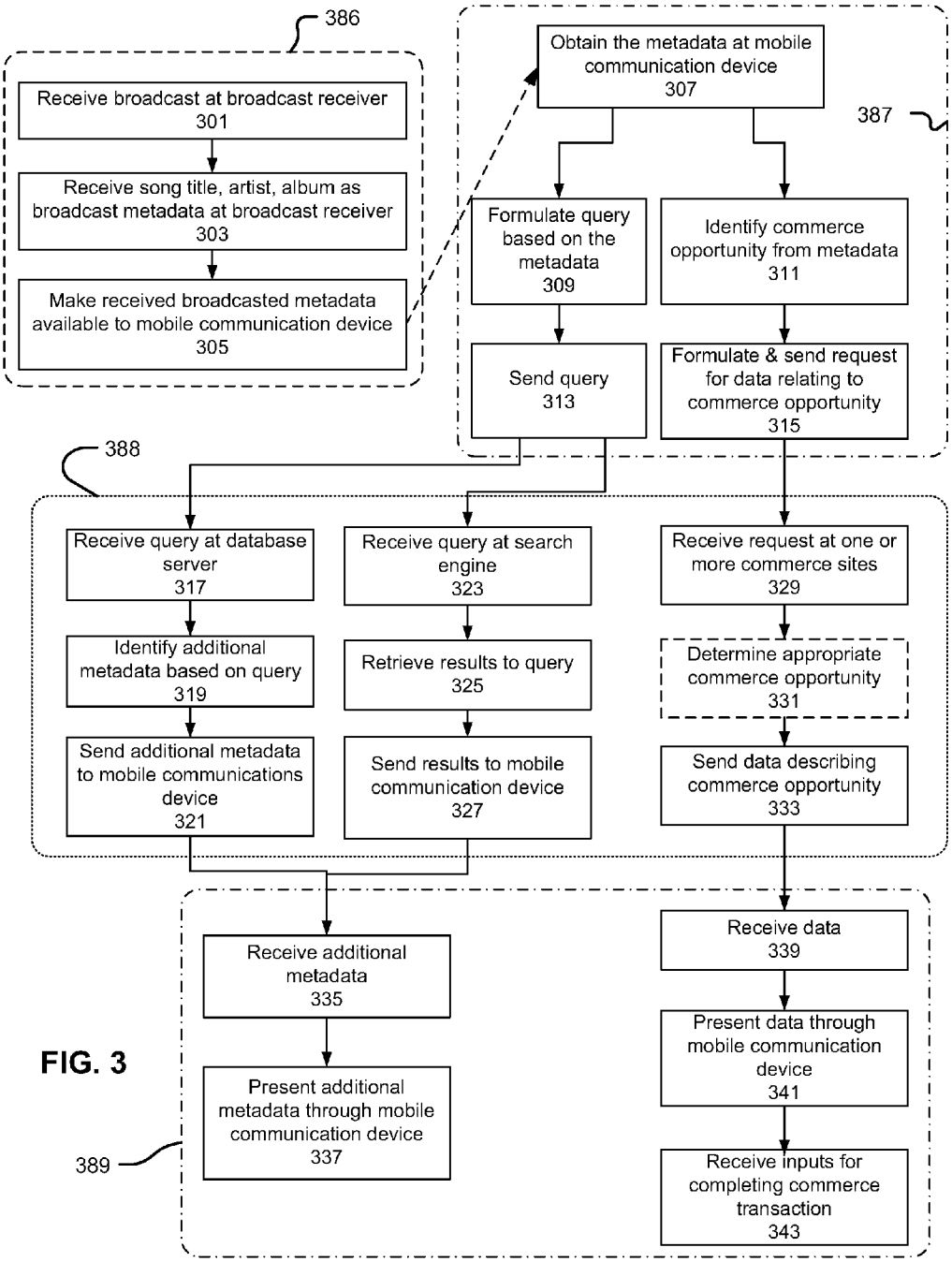
FIG. 3 depicts example methods that can be performed by components depicted in FIG. 1.

FIG. 3 depicts example method aspects that can be implemented by different of the components depicted in FIGS. 1 and 2. For clarity and context, FIG. 3 holistically depicts actions that can be performed by different components, but this depiction does not imply that these actions are all required to be implemented or taken by methods and systems according to these disclosures. Grouping 386 identifies actions that can be performed by receiver 113, grouping 387 identifies actions that can be performed by device 109, grouping 388 identifies steps that can be performed by servers, search engines, content repositories and the like that are available over data network 117. Grouping 389 identifies actions that can be taken by device 109 upon reception of data provided in resolution of the queries and requests formulated in the actions performed in grouping 387.

At 301, receiver 113 receives a broadcast. Such a broadcast can be, for example, receiving an FM radio station. In 303, receiver 113 also receives metadata concerning a current content item being broadcast, such as a current song or advertisement. Such metadata can comprise a song title, album, and artist. In 305, receiver 113 sends that metadata or a portion of it, to device 109. In 307, device 109 obtains the metadata provided by receiver 113, and takes one or more actions based on it. One action that device 109 can take is to formulate (309) a query based on the metadata and send (313) the query to be resolved (described below). Another action can include identifying (311) a commerce opportunity based on the metadata. A query can be formulated and sent (315) based on the identified commerce opportunity. Aspects and further examples of such query formation are described with respect to FIGS. 4 and 5, below.

Examples of actions taken to resolve and use such queries are explained with respect to grouping 388, which comprises actions that can be performed by one or more of content source 114, search engine 103, e-commerce sites 119, and other content sources 115. For example, content source 114 can receive (317) the query (e.g., at database server 150, which stores metadata relating to content being broadcast via broadcast data transmitters 143). Database server 150 can identify (319) additional metadata based on the query, and send (321) that additional metadata to device 109.

Database server 150 can identify such additional metadata by using information comprised in the query, such as a current radio station to which receiver 113 is tuned (information of such having been provided by receiver 113 to device 109 as metadata). Database server 150 can reference a performance schedule for that station, and obtain additional metadata for a current content item being performed on that station. Database server 150 also can retrieve identification information for items that will be performed (according to the schedule) on that station, and preemptively send that information to mobile device, or stage that information in the network so that it can be provided with lower latency to the device. Upon having received such a query, database server 150 can register a given mobile device (e.g., mobile device 109) as having requested additional metadata for an identified station or program, and continue to provide such metadata without mobile device 109 having to renew a request for it.

Database server 150 also can be responsible for loading updated metadata and content in the information stores depicted (e.g., in metadata 123 and content source 121).

The query sent in 313 (described above) also can be received (323) at a search engine that can be configured for Internet searching, for example. A search engine selected to receive (323) such a query (e.g., in an HTTP request) can be pre-configured on device 109. Such pre-configuration can be determined based on a commercial arrangement with the search engine provider. The search engine also can be selected based on a type of content desired to be retrieved, which can be specified in the request. Results can be retrieved (325) automatically by the search engine to be presented (327) to device 109. Sources of such results also can be directed to provide these results directly to device 109. Such results can include locations at which related content can be purchased, album art, and other data. For example, a search can specify a type of data which is desired to be retrieved, for example lyrics for a song being played on receiver 113 can be concurrently displayed on device 109 even though the lyrics are not broadcast in metadata 123. While in other cases, a search engine can respond with a selection of available data.

In still other cases, a given item of content being performed on receiver 113 can be a commercial for a product or service. Metadata provided with the commercial can include a website or other data that indicates a desired action to be taken, or a website to be visited, in response to the commercial. For example, further information about an advertised product can be made available. The information can present a page that allows a user of device 109 to purchase a product or service advertised. Further advertiser discount or coupons may be made available to the consumer if the advertiser is contacted at a result of the metadata.

The content described above (query results, commerce opportunity information, and so on) can be provided from their respective sources for delivery to device 109, such as through data networks 117, and through one or more of WLAN AP 114 and RAN 107. In one example, device 109 can receive (335) additional metadata provided as a result of a query to one or more of database server 150 and a search engine (e.g., search engine 103). Device 109 can then present (337) that additional metadata, such as on a display, or through another means detectable to a user (such as audibly through a speaker). Device 109 also can receive (339) the data descriptive of a commerce opportunity (see 333, above) and present (341) that data on device 109, such as through a display. Inputs can be received (343) by device 109 responsive to presentation of the data, such as inputs for consummating a transaction. Such inputs can include presentation of payment information. As will be described below, such inputs can be generated by device 109 based on a configuration provided by a device user, or based on other parameters, rather than necessarily being provided directly from a user.

FIG. 4 depicts a schematic view of how device 109 can process metadata received based on configuration information stored at device 109. FIG. 4 depicts that a metadata interpreter 402 module can be provided with device 109. Metadata interpreter 402 can receive configuration information from a storage 406 of configuration information. Such configuration information can comprise a default or preferred search provider or list of search providers. Preferred search providers also can be provided for different kinds of queries, or for different broadcasting entities (e.g., a given station can have an affiliation with a different search provider, and that information can be stored on device 109).

Other configuration information can include a preferred site to which device 109 will connect in order to purchase content or other items identified based on metadata provided from receiver 113. Format information can be stored. For example, formats of queries to be completed with different kinds of metadata can be stored. Specific URLs to retrieve different kinds of metadata also can be stored. For example, a URL for a server resource at which album art can be downloaded can be stored. As above, different URLs can be provided for different sources of broadcast content.

FIG. 5 depicts aspects of an example method of processing metadata received by device 109 from receiver 113. For a given item of received metadata, a decision (502) can be made as to whether the element is an entertainment item, such as a song, and if so, then configuration information can be accessed (504), which can be used in controlling the device to form (506) a request to obtain commercial transaction data for an item identified by the metadata or other data for that item. For example, the configuration can indicate that an HTTP request to a pre-determined resource, with parameters including one or more elements of the metadata, is to formed (506) and transmitted from device 109. Additionally or alternatively, a request can be formed (508) to an identified server for obtaining further metadata about that item (e.g., album art or song lyrics). The URL used in forming the request can be a URL identified in the metadata received from receiver 113 or a URL stored on device 109 as configuration information. In other implementations, multiple requests can be generated to obtain data from a plurality of sources.

The method depicted in FIG. 5 can detect (514) and process detected advertisement related metadata differently than entertainment items. For example, metadata associated with an advertisement can include data indicating a location where more information about an item or a purchase location for an item can be accomplished. That "available at" information can be accessed (512) and used in forming (510) an HTTP request based on that information. Device 109 also can be configured for performing a search for other available data about a given item being broadcast (or an item referred to in a given broadcast).

Embodiments may implement only a portion of the method depicted in FIG. 5. For example, some embodiments may use an included "available at" web address for all queries, while other embodiments may use a pre-defined query format in which detected metadata elements are inserted. Some embodiments can be configured to send a single query, while other embodiments can be configured to send a plurality of queries to different sources. Such configuration can be user-defined. As described above, destinations for such queries can also be configured by a provider of the device, by a user, or both.

Figure 6:
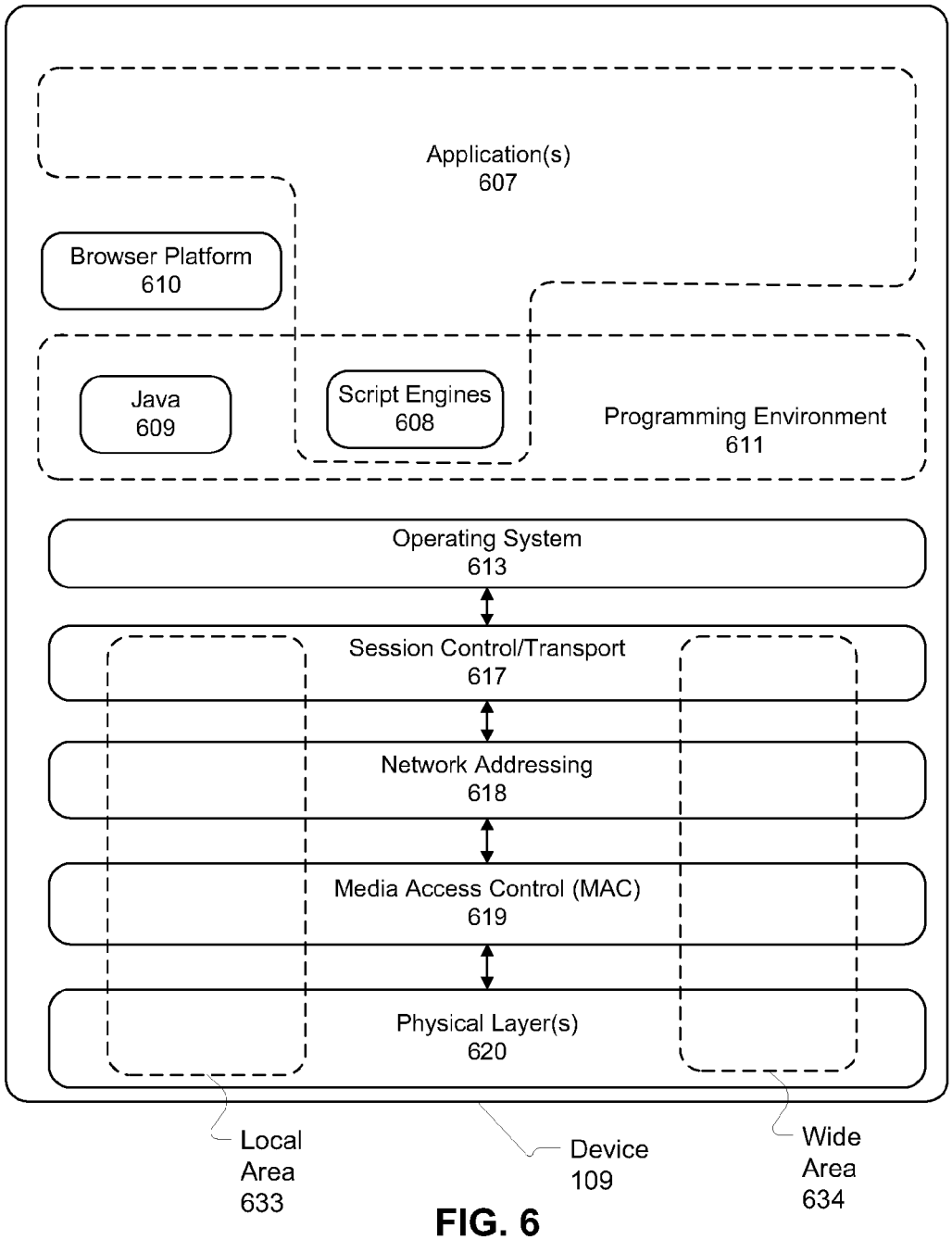
FIG. 6 depicts a functional module view of a mobile transceiver device that can be used in the FIG. 1 system.

FIG. 6 depicts an example functional arrangement for an embodiment of device 109. According to FIG. 6, device 109 can comprise a local area network 633 and wide area network 634 capabilities. To implement these capabilities, FIG. 6 depicts that device 109 comprises one or more physical layers 620, which communicate with one or more Media Access Control (MAC) functions (619) appropriate for the physical media. For example, MAC algorithms for a local area wireless technology such as 802.11 desirably are different from a MAC for a cellular wireless technology and from a wired local area network. Respective MAC layers communicate with a network addressing layer (618). Network addressing can be common between different networks, for example Internet Protocol (IP) addressing can be used over 802.11 type wireless LANs, Bluetooth, and cellular wireless. Network address 618 communicates with a session control/transport layer (617); common transport protocols include TCP and UDP, both of which can be used with IP addressing. An operating system 613 can communicate with the session control/transport (617) functions, on behalf of applications. The logical division depicted here is for explanation purposes and some embodiments can provide an operating system that comprises session control/transport 617 and network addressing 618 functionality.

Operating system 613 provides a platform on which applications can be developed. A programming environment 611 can be provided as part of operating system 613 or as an additional middle ware layer to which applications can be developed. For example, programming environment 611 can comprise a set of script engines 608, and a java 609 implementation. Script engines 608 comprise interpreters for scripting languages in which scripts to accomplish tasks can be written. Java 609 can provide a set of pre-defined routines and other functions that can be called by an application. A browser platform 610 can be written to use the script engines 608 and Java 609 implementation. Browser platform 610 can comprise markup and script language renderers. Browser platform 610 may install Java 609 and script engines 608, which it will use. Applications 607 can be written to use browser platform 610, Java 609, script engines 608, as well as other functions provided by operating system 613. Applications 607 can be written to use programming interfaces provided by these elements, such as using published procedure names and passing appropriate arguments when calling such procedures. Applications also can inter-operate and exchange information, either using operating system 613 or by another programming model.

One application that can be provided in such a device is an application that performs according to the Microsoft Sync model, except that the application is extended to allow communication from the built-in computer to the application running on the device, rather than only allowing communication from the device to the built-in computer, as presently is the case. Another application that can be provided for use in the device depicted in FIG. 6 is an application that processes metadata from a broadcast receiver according to the examples described above.

Figure 7:
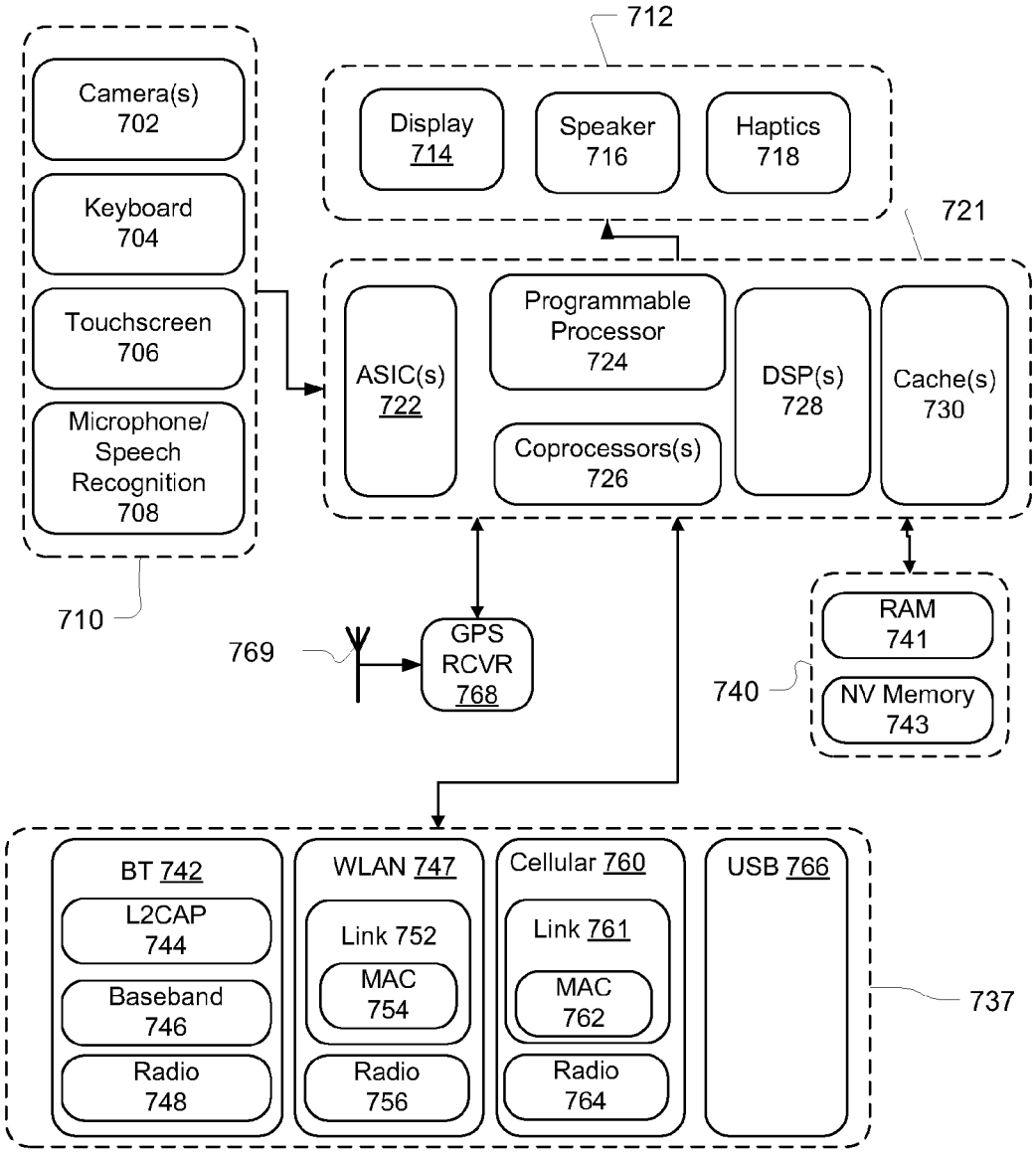
FIG. 7 depicts example functional blocks of a mobile transceiver device, which can be used in implementing the functional modules depicted in FIG. 4.

FIG. 7 depicts example components that can be used in implementing a mobile transceiver device 109 according to the above description. FIG. 7 depicts that a processing module 721 may be composed of a plurality of different processing elements, including one or more ASICs 722, a programmable processor 724, one or more co-processors 726, which each can be fixed function, reconfigurable or programmable, one or more digital signal processors 728. For example, an ASIC or co-processor may be provided for implementing graphics functionality, encryption and decryption, audio filtering, and other such functions that often involve many repetitive, math-intensive steps. Processing module 721 can comprise memory to be used during processing, such as one or more cache memories 730.

Processing module 721 communicates with mass storage 740, which can be composed of a Random Access Memory 741 and of non-volatile memory 743. Non-volatile memory 743 can be implemented with one or more of Flash memory, PROM, EPROM, and so on. Non-volatile memory 743 can be implemented as flash memory, ferromagnetic, phase-change memory, and other non-volatile memory technologies. Non-volatile memory 743 also can store programs, device state, various user information, one or more operating systems, device configuration data, and other data that may need to be accessed persistently.

User input interface 710 can comprise a plurality of different sources of user input, such as a camera 702, a keyboard 704, a touchscreen 706, and a microphone, which can provide input to speech recognition functionality 708. Processing module 721 also can receive input from a GPS receiver 768, which processes signals received from antenna 769. Processing module 721 also can use a variety of network communication protocols, grouped for description purposes here into a communication module 737, which can include a Bluetooth communication stack 742, which comprises a L2CAP layer 744, a baseband 746 and a radio 748. Communications module 737 also can comprise a Wireless Local Area Network (747) interface, which comprises a link layer 752 with a MAC 754, and a radio 756. Communications module 737 also can comprise a cellular broadband data network interface 750, which in turn comprises a link layer 761, with MAC 762. Cellular interface 750 also can comprise a radio for an appropriate frequency spectrum 764. Communications module 737 also can comprise a USB interface 766, to provide wired data communication capability. Other wireless and wired communication technologies also can be provided, and this description is exemplar In addition, separate boxes or illustrated separation of functional elements of illustrated systems does not necessarily require physical separation of such functions, as communications between such elements can occur by way of messaging, function calls, shared memory space, and so on, without any such physical separation. As such, functions need not be implemented in physically or logically separated platforms, although they are illustrated separately for ease of explanation herein.

For example, different embodiments of devices can provide some functions in an operating system installation that are provided at an application layer or in a middle layer in other devices. Different devices can have different designs, such that while some devices implement some functions in fixed function hardware, other devices can implement such functions in a programmable processor with code obtained from a computer readable medium.

More generally, a person of ordinary skill would be able to adapt these disclosures to implementations of any of a variety of communication devices. Similarly, a person of ordinary skill would be able to use these disclosures to produce implementations and embodiments on different physical platforms or form factors without deviating from the scope of the claims and their equivalents.

I claim:

1. A method of augmenting broadcast data transmitted by at least one broadcast data transmitter, with other data using a mobile transceiver device, comprising:

receiving, at a mobile transceiver device, metadata associated with a broadcast, the metadata derived from a broadcast received by a broadcast radio receiver separate from the mobile transceiver device;

automatically formulating a search query at the mobile transceiver device based on the received metadata, wherein automatically formulating of the search query comprises accessing configuration information for obtaining identification information of a preferred recipient of the search query, the search query being formulated according to a pre-configured search engine associated with the preferred recipient, the pre-configured search engine being automatically selected based on a type of content to be searched;

sending the formulated search query from the mobile transceiver device to a wireless data network;

receiving a response to the search query at the mobile transceiver device, the response including additional metadata based on information in the query, the additional metadata corresponding to a current content item being performed on the broadcast data transmitter and corresponding to identification information for at least one additional content item that will be performed on the broadcast data transmitter, based on a performance schedule for the broadcast data transmitter, and the information in the query including the identity of the broadcast data transmitter to which the broadcast radio receiver is tuned; and performing, through one or more output functions of the mobile transceiver device, content obtained from the search query response while the broadcast radio receiver performs content from the broadcast.

2. The method of claim 1, wherein the content obtained from the search query response comprises enhanced metadata comprising one or more of album art and song lyrics for a song being performed by the broadcast radio receiver.

3. The method of claim 2, wherein the performing comprises displaying album art on a display of the mobile transceiver device.

4. The method of claim 2, wherein the performing comprises displaying song lyrics on a display of the mobile transceiver device.

5. The method of claim 1, wherein the performing comprises displaying content for consummating a transaction on the mobile transceiver device.

6. The method of claim 1, wherein the content obtained from the search query response comprises enhanced metadata comprising a video associated with a song, and the performing comprises performing the video on a display of the mobile transceiver device while the song is performed through speakers connected to the broadcast radio receiver.

7. The method of claim 1, wherein the content obtained from the search query comprises information relating to an advertisement being performed by the broadcast radio receiver.

8. The method of claim 1, wherein the content obtained from the search query comprises content providing a capability to complete a transaction relating to an advertisement being performed by the broadcast radio receiver.

9. The method of claim 1, wherein the accessed configuration information comprises a Uniform Resource Locator for a source of the content obtained from the search query response.

10. The method of claim 1, wherein the broadcast includes content and the broadcast radio receiver performs the content within a limited area and further wherein the mobile transceiver device is wirelessly coupled to the broadcast radio receiver and is located within the limited area.

11. The method of claim 1, wherein the performing comprises displaying content for consummating a transaction on the mobile transceiver device.

12. The method of claim 1, wherein the content obtained from the search query response comprises enhanced metadata comprising a video associated with a song, and the performing comprises performing the video on a display of the mobile transceiver device while the song is performed through speakers connected to the broadcast radio receiver.

13. The method of claim 1, wherein the identification information of the preferred recipient of the search query comprises a preferred search engine.

14. A non-transitory computer readable medium storing computer executable instructions for performing a method in a mobile transceiver device, comprising:

receiving, over a local communication link, from a broadcast receiver separate from the mobile transceiver device, metadata relating to a main program received by the broadcast receiver;

automatically formulating a search query at the mobile transceiver device based on the received metadata, wherein automatically formulating of the search query comprises accessing configuration information for obtaining identification information of a preferred recipient of the search query, the search query being formulated according to a pre-configured search engine associated with the preferred recipient, the pre-configured search engine being automatically selected based on a type of content to be searched;

sending a request to a broadband data access network, the request including the identification information of the preferred recipient of the search query;

sending the formulated search query from the mobile transceiver device over the broadband data access network;

receiving additional information responsive to the formulated search query over the broadband data access network, the additional information including additional metadata based on information in the search query, the additional metadata corresponding to a current content item being performed on a broadcast transmitter performing the main program and corresponding to identification information for at least one additional content item that will be performed on the broadcast data transmitter, based on a performance schedule for the broadcast data transmitter, and the information in the search query including the identity of the broadcast data transmitter; and outputting the additional information through the mobile transceiver device concurrently with performance of the main program by the broadcast receiver.

15. The non-transitory computer readable medium of claim 14, further storing configuration information comprising a Uniform Resource Locator template to be used in forming the request for additional information.

16. The non-transitory computer readable medium of claim 14, further storing configuration information comprising a Uniform Resource Locator template identifying a network resource at which a transaction can be conducted, the transaction based at least in part on the metadata received over the local communication link.

17. A mobile transceiver device, comprising:

a processor module;

a local communication interface;

a display;

a broadband wireless data communication interface; and a memory storing configuration data and program code to cause the processor module to perform a method comprising receiving, over the local communication interface, metadata for a program being received by a broadcast radio receiver separate from the mobile transceiver device, automatically formulating a request based on the received metadata, wherein formulating of the request comprises accessing configuration information for obtaining identification information of a preferred recipient of the request, the request formulated according to a pre-configured search engine associated with a preferred request recipient, the pre-configured search engine being automatically selected based on a type of content to be searched, sending the formulated request over the broadband wireless data communication interface, the request comprising the identification information of the preferred recipient of the request, receiving a response to the request comprising additional information and additional meta data based on information in the request, the additional information and additional meta data corresponding to a current content item being performed on a broadcast transmitter performing the program and corresponding to identification information for at least one additional content item that will be performed on the broadcast transmitter, based on a performance schedule for the transmitter and the information in the request including the identity of the broadcast transmitter, and outputting the additional information from the display based on the additional metadata, while the broadcast radio receiver performs content from the program.

18. The mobile transceiver device of claim 17, wherein the local communication interface comprises a Bluetooth interface.

19. The mobile transceiver device of claim 17, wherein the local communication interface comprises a USB interface.

20. The mobile transceiver device of claim 17, wherein the outputting of the additional information comprises displaying album art on the display.

21. The mobile transceiver device of claim 17, wherein the outputting of the additional information comprises displaying song lyrics for a song being performed by the broadcast radio receiver on the display.

* * * * *